United States Patent [19]

Masterton

[11] Patent Number: 4,691,138

[45] Date of Patent: Sep. 1, 1987

[54] COLOR PICTURE TUBE HAVING SHADOW MASK WITH VARIED APERTURE COLUMN SPACING

[75] Inventor: Walter D. Masterton, Lancaster, Pa.

[73] Assignee: RCA Corporation, Princeton, N.J.

[21] Appl. No.: 2,321

[22] Filed: Jan. 12, 1987

Related U.S. Application Data

[63] Continuation of Ser. No. 711,721, Mar. 14, 1985, abandoned.

[51] Int. Cl.[4] ..... H01J 29/07

[52] U.S. Cl. ..... 313/403; 313/408; 313/402

[58] Field of Search ..... 313/402, 403, 408

[56] References Cited

U.S. PATENT DOCUMENTS

| | | | |
|---|---|---|---|
| 3,590,303 | 6/1971 | Coleclough | 313/92 |
| 3,889,145 | 6/1975 | Suzuki et al. | 313/408 |
| 3,925,700 | 12/1975 | Saito | 313/403 |
| 3,947,718 | 3/1976 | van Lent | 313/408 |
| 4,136,300 | 1/1979 | Morrell | 313/403 |
| 4,583,022 | 4/1986 | Masterton | 313/403 |
| 4,636,683 | 1/1987 | Tokita et al. | 313/403 |
| 4,638,212 | 1/1987 | Nakamura | 313/402 X |

FOREIGN PATENT DOCUMENTS

| | | |
|---|---|---|
| 2656995 | 5/1978 | Fed. Rep. of Germany . |
| 1460666 | 1/1977 | United Kingdom . |
| 1578491 | 11/1980 | United Kingdom . |

*Primary Examiner*—David K. Moore
*Assistant Examiner*—K. Wieder
*Attorney, Agent, or Firm*—Eugene M. Whitacre; Dennis H. Irlbeck

[57] ABSTRACT

An improvement is made in a color picture tube having a substantially rectangular slit-aperture type shadow mask mounted therein in spaced relation to a substantially rectangular cathodoluminescent line screen. In the specific improvement, the spacing between adjacent aperture columns near the minor axis of the mask is less at the long sides of the mask than near the major axis of the mask.

3 Claims, 10 Drawing Figures

COLOR PICTURE TUBE HAVING SHADOW MASK WITH VARIED APERTURE COLUMN SPACING

This is a continuation, of application Ser. No. 711,721, filed Mar. 14, 1985 abandoned.

This invention relates to color picture tubes of the type having a slit-aperture type apertured shadow mask mounted in close relation to a cathodoluminescent line screen of the tube and, particularly, to an improvement in mask aperture column spacing within such tubes that permits an improved mask contour.

Most color picture tubes presently being manufactured are of the line screen-slit mask type. These tubes have spherically contoured rectangular faceplates with line screens of cathodoluminscent materials thereon, and somewhat spherically contoured slit-apertured shadow masks adjacent to the screens. The slit-shaped apertures in such tubes are arranged in columns that substantially parallel the minor axis of the tube or gradually increase in curvature from the center to the short sides of the mask.

Recently, several color picture tube modifications have been suggested. One of these modifications is a new faceplate panel contour concept which creates the illusion of flatness. Such tube modification is disclosed in three recently-filed, copending U.S. Applications: Ser. No. 469,772, filed by F. R. Ragland, Jr. on Feb. 25, 1983; Ser. No. 469,774, filed by F. R. Ragland, Jr. on Feb. 25, 1983; and Ser. No. 529,644, filed by R. J. D'Amato et al. on Sept. 6, 1983 now abandoned. The faceplate contour of the modified tube has curvature along both the major and minor axes of the faceplate panel, but is nonspherical. The major and minor axes are defined as the central horizontal and vertical axes, respectively, when the tube is positioned in its normal viewing position. In a preferred embodiment described in these applications, the peripheral border of the tube screen is substantially planar and visually appears to be planar. In order to obtain this planar or substantially planar peripheral border, it is necessary to form the faceplate panel with a curvature along its major axis that is greater at the sides of the panel than at the center of the panel. Such nonspherical shaping of the faceplate panel creates a problem involving shadow mask contour. If the shadow mask is formed with straight cross-sections parallel to the minor axis along its sides, the mask may have poor mechanical characteristics, such as undesirable microphonics and/or doming problems. Therefore, it is desirable to form the mask with more curvature at these cross-sections than may be suggested by the faceplate panel contour. Such mask contour modification, however, requires other changes in the tube, including changes in the mask aperture pattern.

In the first line screen-slit mask type tubes, the shadow masks were almost spherical and the separation of the adjacent aperture columns along the major axis (horizontal separation) was held constant over the mask. However, some later tubes of this type included a shadow mask with increased curvature and incorporated an aperture column spacing variation taught in U.S. Pat. No. 4,136,300, issued to A. M. Morrell on Jan. 23, 1979. In such later tubes, the spacing between centerlines of adjacent columns of apertures increased from center-to-edge of the mask. This increase varied along the major axis generally as the square of the distance from the minor axis.

A new aperture column-to-column spacing is disclosed in copending U.S. Application Ser. No. 615,589, filed by W. D. Masterton on Mar. 31, 1984 now U.S. Pat. No. 4,583,022. In this application, the spacing between adjacent aperture columns increases from the center to the sides of the shadow mask as approximately the fourth power of the distance from the minor axis of the shadow mask. This variation in column spacing can be expressed as a coefficient times the fourth power of the distance, wherein the coefficient is variable, being larger for cross-sections of the mask that are parallel to but off the central horizontal axis than for cross-sections on the central horizontal axis. This fourth power variation has proven adequate for the shadow mask contours of the first generation of substantially planar tubes. Such first generation tubes have shadow masks with substantially more curvature along the minor axis than along the major axis. However, the mask curvatures at cross-sections parallel to the minor axis decrease in curvature from the minor axis to the sides of the mask to become relatively flat at the sides of the mask. Such flatness is undesirable in a shadow mask since it is more susceptible to deformation during handling and has a somewhat unpredictable flexture when heated during tube operation. The present invention provides an improvement in aperture column-to-column spacing which permits various curvature trade-offs in such shadow masks to attain greater curvature at the sides of the masks.

SUMMARY OF THE INVENTION

An improvement is made in a color picture tube having a substantially rectangular slit-aperture type shadow mask mounted therein in spaced relation to a substantially rectangular cathodoluminescent line screen. In the specific improvement, the spacing between adjacent aperture columns near the minor axis of the mask is less at the long sides of the mask than near the major axis of the mask.

DETAILED DESCRIPTION OF THE PREFERRED EMBODIMENTS

Figure 1:
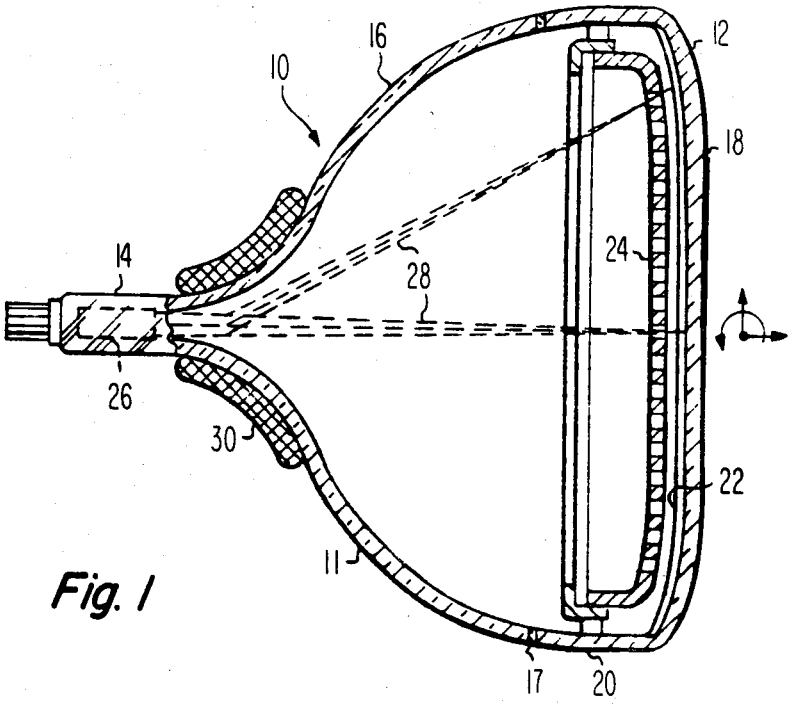
FIG. 1 is a plan view, partly in axial section, of a shadow mask color picture tube incorporating one embodiment of the present invention.

FIG. 1 shows a rectangular color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A novel rectangular three-color cathodoluminescent phosphor screen 22 is carried by the inner surface of the faceplate 18. The screen is a line screen, with the phosphor lines extending somewhat parallel to the minor axis, Y—Y, of the tube (normal to the plane of FIG. 1). The contours of the phosphor lines are discussed in greater detail below. A novel multi-apertured color selection electrode or shadow mask 24 is removably mounted within the faceplate panel 12 in predetermined spaced relation to the screen 22. An inline electron gun 26, shown schematically by dashed lines in FIG. 1, is centrally mounted within the neck 14 to generate and direct three electron beams 28 along initially coplanar convergent paths through the mask 24 to the screen 22.

The tube 10 of FIG. 1 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally in the direction of the major axis (X—X) and vertically in the direction of the minor axis (Y—Y), respectively, in a rectangular raster over the screen 22.

Figure 2:
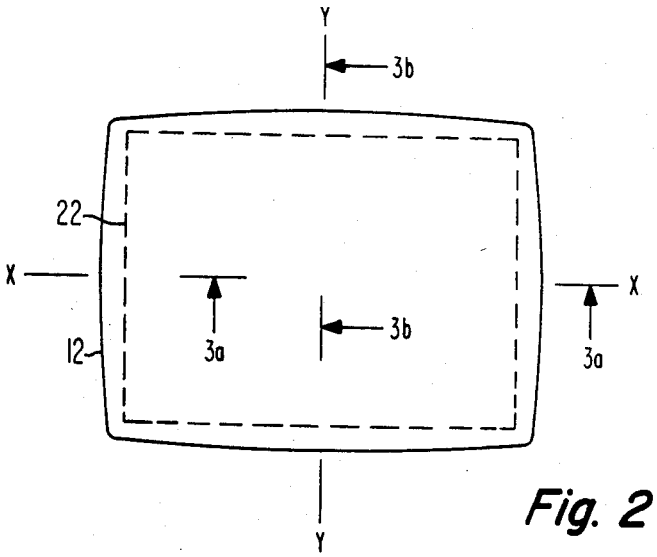
FIG. 2 is a front view of the faceplate of the color picture tube, taken at line 2—2 of FIG. 1.

FIG. 2 shows the front of the faceplate panel 12. The periphery of the panel 12 forms a rectangle with slightly curved sides. The border of the screen 22 is shown with dashed lines in FIG. 2. This screen border is rectangular.

Figure 3:
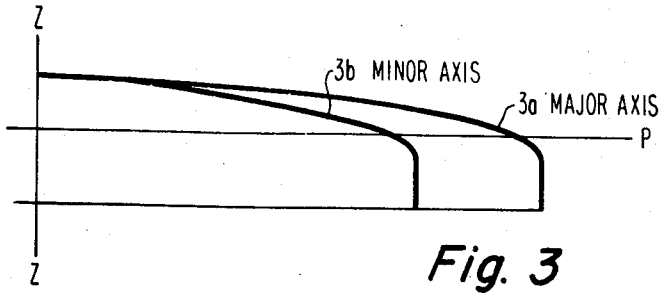
FIG. 3 is a compound view showing the surface contours of the faceplate panel at the major axis, 3*a*—3*a*, and the minor axis, 3*b*—3*b*, cross-sections of FIG. 2.

A comparison of the relative contours of the exterior surface of the faceplate panel 12 along the minor axis, Y—Y, and major axis, X—X, is shown in FIG. 3. The exterior surface of the faceplate panel 12 is curved along both the major and minor axes, with the curvature along the minor axis being greater than the curvature along the major axis in the center portion of the panel 12. For example, at the center of the faceplate, the ratio of the radius of curvature of the exterior surface contour along the major axis to the radius of curvature along the minor axis is greater than 1.1 (a greater than 10% difference). The curvature along the major axis, however, is small in the central portion of the faceplate and greatly increases near the edges of the faceplate. In this one embodiment, the curvature along the major axis, near the edges of the faceplate, is greater than the general curvature along the minor axis. With this design, the central portion of the faceplate becomes flatter, while the points of the faceplate exterior surface at the edges of the screen lie substantially in a plane P and define a substantially rectangular peripheral contour line. The surface curvature along the diagonal is selected to smooth the transition between the different curvatures along the major and minor axes. Preferably, the curvature along the minor axis is about 4/3 greater than the curvature along the major axis in the central portion of the faceplate.

By using the differing curvatures along the major and minor axes, the points on the exterior surface of the panel, directly opposite the edges of the screen 22, lie substantially in the same plane P. These substantially planar points, when viewed from the front of the faceplate panel 12, as in FIG. 2, form a contour line on the exterior surface of the panel that is substantially a rectangle superposed on the edges of the screen 22. Therefore, when the tube 10 is inserted into a television receiver, a uniform width border mask or bevel can be used around the tube. The edge of such a bezel that contacts the tube at the rectangular contour line also is substantially in the plane P. Since the periphery border of a picture on the tube screen appears to be planar, there is an illusion created that the picture is flat, even though the faceplate panel is curved outwardly along both the major and minor axes.

Figure 4:
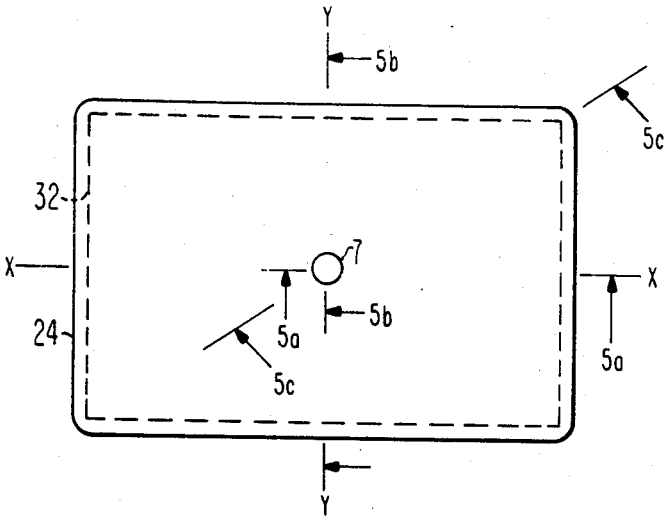
FIG. 4 is a front view of the shadow mask of the color picture tube of FIG. 1.
Figure 5:
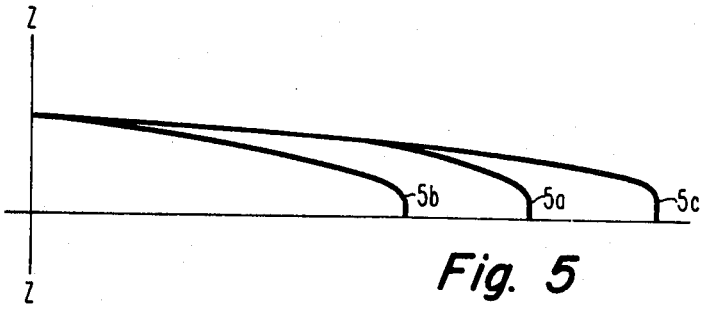
FIG. 5 is a compound view showing the surface contours of the shadow mask at the major axis, 5*a*—5*a*, the minor axis, 5*b*—5*b*, the diagonal, 5*c*—5*c*, cross-sections of FIG. 4.

FIG. 4 shows a front view of the novel shadow mask 24. The dashed lines 32 show the border of the apertured portion of the mask 24. The surface contours along the major axis, X—X, the minor axis, Y—Y, and the diagonal of the mask 24 are shown by the curves **5*a*, 5*b* and 5*c*, respectively, in FIG. 5. The mask 24** has a different curvature along its major axis than along its minor axis. The contour along the major axis has a slight curvature near the center of the mask and greater curvature at the sides of the mask. The contour of such a shadow mask can be generally obtained by describing the major axis, X—X, curvature as a large radius circle over about the central portion of the major axis, and a smaller radius circle over the remainder of the major axis. However, more specifically, the sagital height along the major axis varies substantially as the fourth power of distance from the minor axis, Y—Y. Sagital height is the distance from an imaginary plane that is tangent to the center of the surface of the mask. The curvature parallel to the minor axis, Y—Y, is such as to smoothly fit the major axis curvature to the required mask periphery and can include a curvature variation as is used along the major axis. Such mask contour exhibits some improved thermal expansion characteristics because of the increased curvature near the ends of the major axis. The production of improved thermal expansion characteristics from increased curvature is discussed in the above-cited U.S. Pat. No. 4,136,300.

Figure 6:
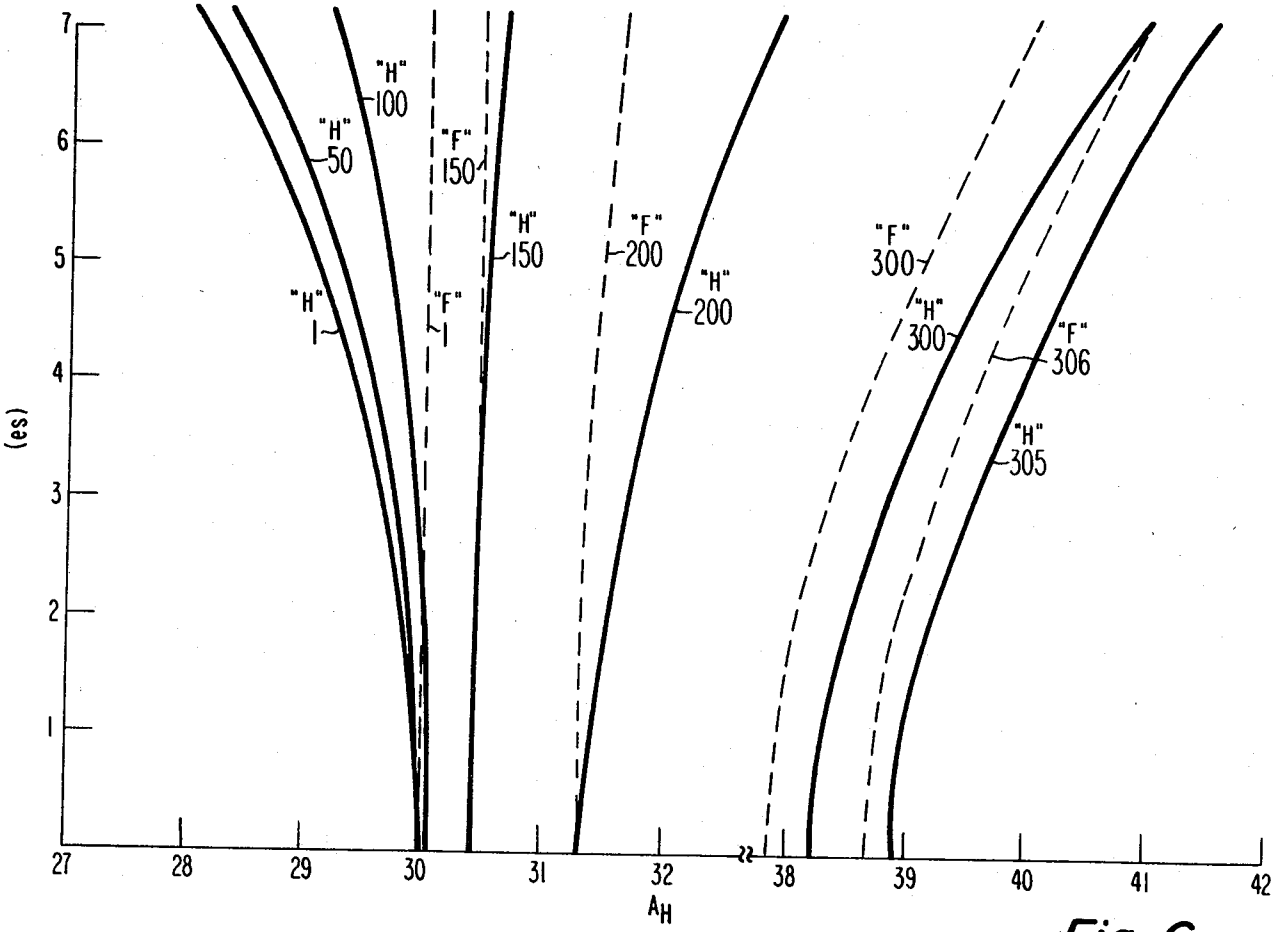
FIG. 6 is a graph of shadow mask aperture column-to-column spacing of the mask of the color picture tube, shown in solid lines, and aperture spacing in a prior mask, shown in dashed lines.
Figure 7:
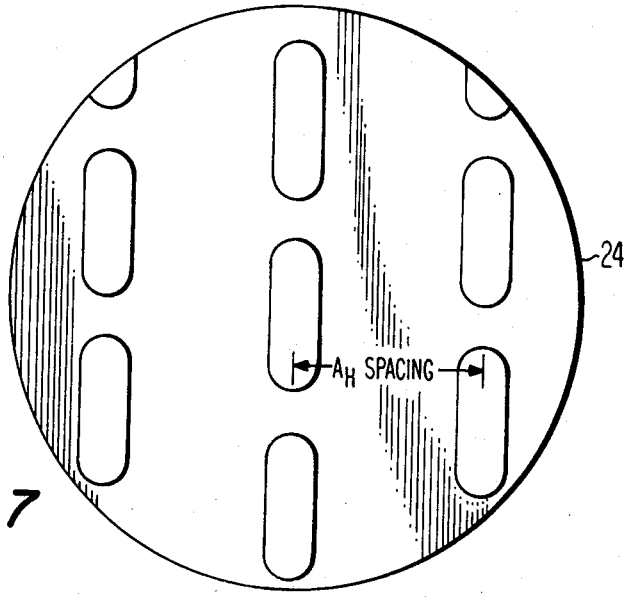
FIG. 7 is an enlarged view of the shadow mask, taken at circle 7 of FIG. 4.

FIG. 6 is a graph showing the aperture column-to-column spacing, $A_H$, within a quadrant of the shadow mask 24, shown in solid curves and labelled "H", and within a quadrant of a shadow mask constructed as described in the above-cited, copending U.S. Application Ser. No. 615,589, shown in dashed curves and labelled "F". The vertical coordinate of the graph represents distance from the major axis. The horizontal coordinate represents the aperture column-to-column spacing which, as shown in FIG. 7, is measured from the centerline of one column to the centerline of the adjacent column. Each curve is numbered to identify the space from the minor axis that it represents. For example, each curve marked 200 identifies the spacing between the 200th and 201st aperture columns.

In the prior shadow mask, shown by the dashed curves, the aperture column-to-column spacing is uniform along and near the minor axis, as indicated by the straight curves "F"-1 and "F"-150. A slight curvature can be noted in line "F" 200, indicating that the column-to-column spacing for space 200 is slightly increasing with distance from the major axis. Curves "F"-300 and "F"-306 have considerable bow in them, indicating a substantial increase in column-to-column spacing with increased distance from the major axis.

The aperture column-to-column spacing of the novel improved shadow mask differs considerably from that of the prior mask near the minor axis. As shown in FIG. 6, the aperture column-to-column spacing, $A_H$, near the minor axis, decreases with increasing distance from the major axis, as shown by curves "H"-1, "H"-50 and "H"-100. Near the 150th space, the aperture column-to-column spacing begins to slightly increase with increasing distance from the major axis, as shown by the slight bow in curve "H"-150. This bowing of the curves, representing aperture column-to-column spacing, increases with distance from the minor axis, as shown by curves "H"-200 and "H"-300, but slightly decreases at the sides of the mask, as can be seen by comparing curve "H"-305 with curve "H"-300.

The aperture column-to-column spacing along the major axis increases approximately as a function of the fourth power of distance from the minor axis. In the particular example shown in FIG. 6, this major axis variation, in mils, is approximately, $A_H=30+0.00185X^4$. However, off the major axis, the aperture column-to-column spacing variation is more complex and varies approximately as the equation, $A_H=a+bx^2+cx^4$; where: a, b and c are different functions of the square of the distance from the major axis, and x is the distance from the minor axis.

Figure 8:
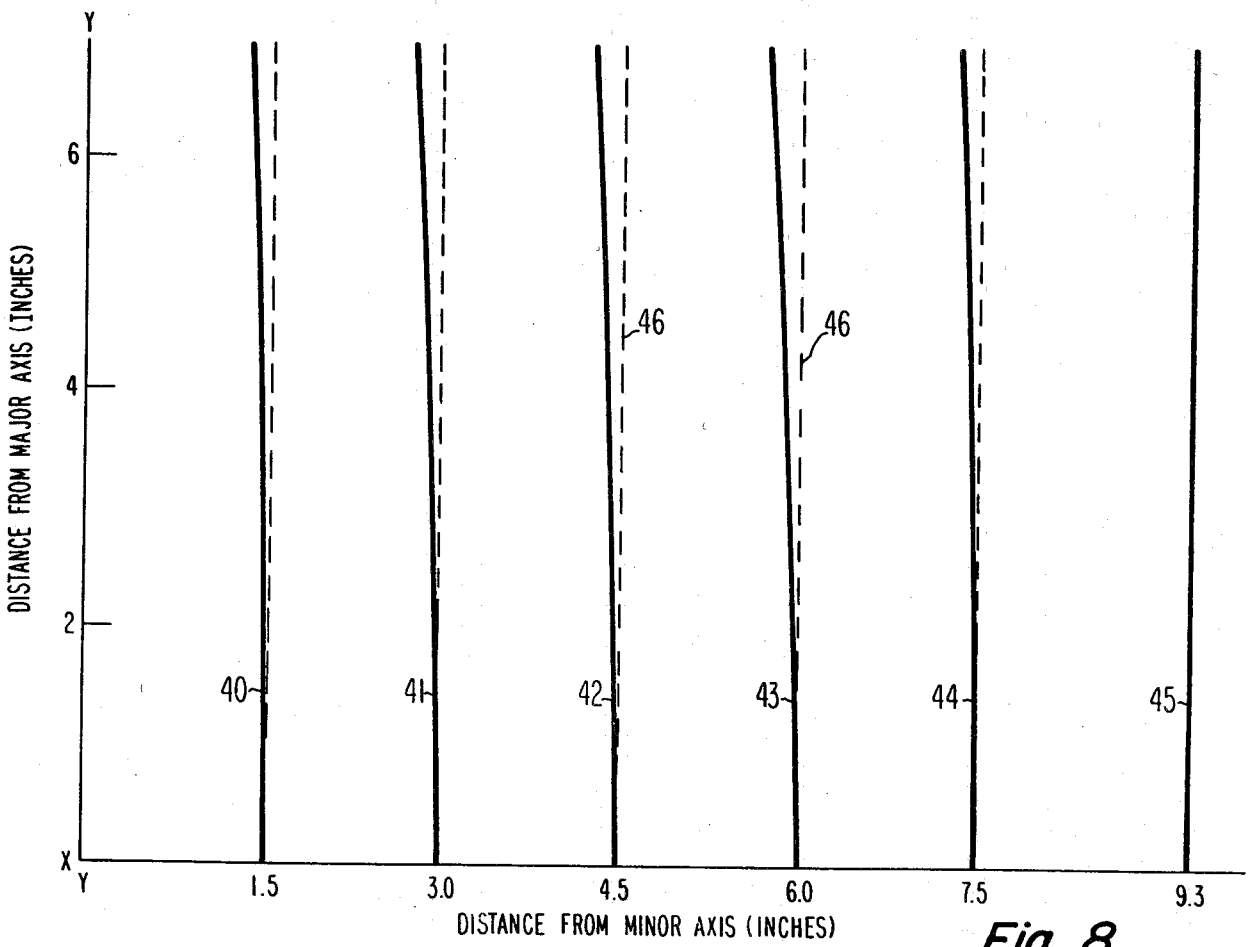
FIG. 8 is a graph of selected screen lines of the color picture tube.

The screen 22 of the tube 10 is formed in a known photographic process that uses the shadow mask 24 as a photographic master. There is a problem that occurs when a linear light source is used during an exposure step of the photographic process. This problem is a misalignment of the image of the linear light source with the centerlines of the phosphor lines. This misalignment, referred to as "skew error", broadens the light intensity distribution used to print the phosphor lines and thereby increases the sensitivity of the phosphor width to light exposure, thus making the control of line width more difficult. In the prior art, compensation has been made for this skew error by various means, including a zonal exposure technique of synchronizing a tilt of the linear light source with a sequential exposure of different screen areas, such as shown in U.S. Pat. No. 3,888,673, issued to Suzuki et al. on June 10, 1975, and a bowing of aperture columns and phosphor lines, such as shown in U.S. Pat. No. 3,889,145, issued to Suzuki et al. on June 10, 1975. In the novel tube 10, the skew problem is solved by the variation of aperture column-to-column spacing as a function of both distance from the minor axis and distance from the major axis. The resultant phosphor line pattern includes bowed lines in a region of the screen where the skew error is the greatest and straight lines at the sides of the screen where skew error in the present tube is minimum. Such pattern is shown in FIG. 8, wherein the solid lines 40 to 45 represent selected spaced phosphor lines, and the dashed lines 46 represent straight lines parallel to the minor axis. As can be seen, the curvature of the phosphor lines increases with increasing distance from the minor axis, until a maximum curvature in the line 42 to line 43 vicinity, and then decreases until the end line 45 which is straight.

Figure 10:
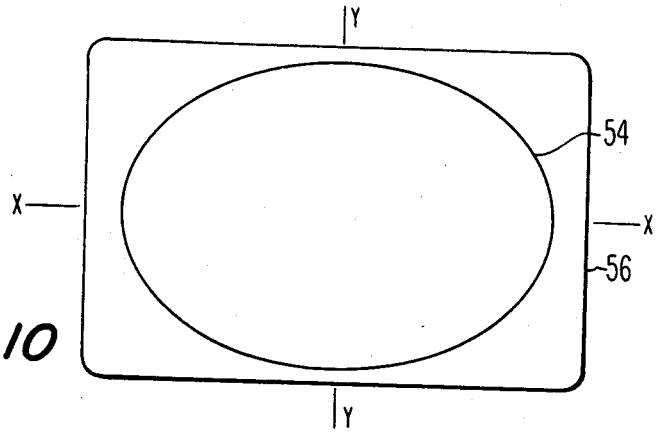
FIG. 10 is a front view of an improved shadow mask showing a contour line thereon of constant saggital height.
Figure 9:
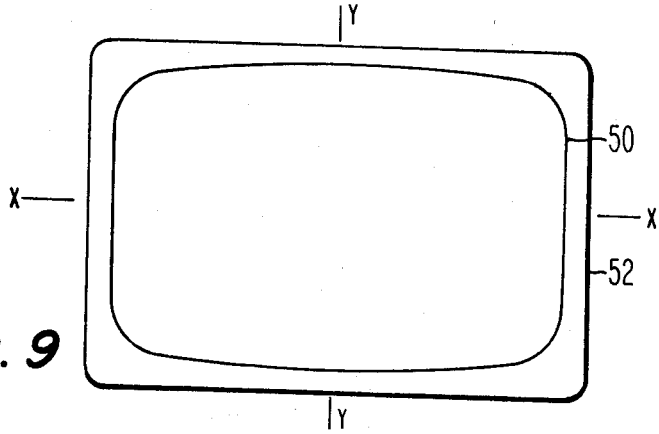
FIG. 9 is a front view of a shadow mask, suggested by faceplate curvature, showing a contour line thereon of constant saggital height.

An advantage of the novel aperture column spacing is that its use permits greater curvature of the shadow mask, in cross-sections near the sides of the mask that parallel the minor axis, than would be possible without its use. The contour of the faceplate panel, having a substantially planar edge, suggests a mask contour as shown by the dashed line 50 in FIG. 9. The line 50 represents a contour line on a mask 52 of equal saggital height. As can be seen, the line 50 is substantially straight at the left and right sides of the mask. This straightness creates substantial forming and handling problems. For example, a slight touch on the mask may cause it to flex inwardly during normal handling. Therefore, it is desirable to design the mask with greater curvature at the sides of the mask to prevent this problem. Use of the novel aperture column spacing permits an improved mask contour, such as shown by the dashed line 54 in FIG. 10. The line 54 represents a contour line on a mask 56 of equal saggital height. In this case, it can be seen that the line 54 is substantially curved at the left and right sides of the mask, thereby giving it greater curvature parallel to the minor axis and thus greater strength.

What is claimed is:

1. In a color picture tube including a shadow mask mounted adjacent to a cathodoluminescent line screen, said shadow mask including a plurality of slit-shaped apertures therein located in columns, said shadow mask having a substantially somewhat rectangular periphery with two opposing long sides and two opposing short sides, a major axis of said mask being an axis passing through the center of the mask and centrally extending through the short sides, and a minor axis of said mask being an axis passing through the center of the mask and centrally extending through the long sides, and said aperture columns generally extending in the direction of the minor axis and being spaced from each other in the direction of the major axis, the improvement comprising the aperture column-to-column spacing near the minor axis of said mask being less at the long sides of said mask than near the major axis of said mask, the aperture column-to-column spacing being greater near the corners of said mask than near the major axis, and the aperture column-to-column spacing along cross-sections parallel to the major axis but off the major axis varying approximately as the equation, $A=a+bx^2+cx^4$, where: A is the column-to-column spacing, a, b and c are different functions of the square of the distance from the major axis, and x is distance from the minor axis.

2. The tube as defined in claim 1, wherein the aperture column-to-column spacing along the major axis increases approximately as a function of the fourth power of distance from the minor axis.

3. In a color picture tube including a shadow mask mounted adjacent a cathodoluminescent line screen, said shadow mask including a plurality of slit-shaped apertures therein located in columns, said shadow mask having a substantially somewhat rectangular periphery with two opposing long sides and two opposing short sides, a major axis of said mask being an axis passing through the center of the mask and centrally extending through the short sides, and a minor axis of said mask being an axis passing through the center of the mask and centrally extending through the long sides, and said aperture columns generally extending in the direction of the minor axis and being spaced from each other in the direction of the major axis, the improvement comprising the aperture column-to-column spacing near the minor axis of said mask being less at the long sides of said mask than near the major axis of said mask, the aperture column-to-column spacing being greater near the corners of said mask than near the major axis, and the aperture column-to-column spacing along the major axis increasing approximately as a function of the fourth power of distance from the minor axis.

* * * * *